US007990321B2

(12) United States Patent
Shih

(10) Patent No.: US 7,990,321 B2
(45) Date of Patent: Aug. 2, 2011

(54) MULTIBAND ANTENNA

(75) Inventor: Yen-Yi Shih, Taipei Hsien (TW)

(73) Assignee: Hon Hai Precision Industry Co., Ltd., Tu-Cheng, New Taipei (TW)

( * ) Notice: Subject to any disclaimer, the term of this patent is extended or adjusted under 35 U.S.C. 154(b) by 312 days.

(21) Appl. No.: 12/422,211

(22) Filed: Apr. 10, 2009

(65) Prior Publication Data

US 2010/0182202 A1 Jul. 22, 2010

(30) Foreign Application Priority Data

Jan. 16, 2009 (CN) ..... 2009 1 0300236

(51) Int. Cl.
*H01Q 1/38* (2006.01)

(52) U.S. Cl. ..... 343/700 MS; 343/702; 343/846

(58) Field of Classification Search ..... 343/700 MS, 343/702, 846, 833, 834
See application file for complete search history.

(56) References Cited

U.S. PATENT DOCUMENTS 6,552,686 B2 * 4/2003 Ollikainen et al. .... 343/700 MS
7,602,341 B2 * 10/2009 Wei-Shan et al. ..... 343/700 MS
2007/0279289 A1 12/2007 Baliarda et al.

* cited by examiner

*Primary Examiner* — Hoang V Nguyen
(74) *Attorney, Agent, or Firm* — Frank R. Niranjan

(57) ABSTRACT

A multiband antenna is located on a substrate and comprises a first radiator, a second radiator, a feeding portion, a grounding portion and a third radiation. The first radiator transmits at least two frequency band signals. The second radiator is connected to the first radiator, and is arranged so as to surround the first radiator. The feeding portion feeds electromagnetic signals to the first radiator and the second radiator. The third radiator is located between the grounding portion and the second radiator, and electrically connected to the grounding portion.

15 Claims, 3 Drawing Sheets

MULTIBAND ANTENNA

BACKGROUND

1. Technical Field

Embodiments of the present disclosure relate to antennas, and more particularly to a multiband antenna.

2. Description of Related Art

Different wireless communication technologies may require different antennas in order to deliver service to wireless customers. For example, global system for mobile communications (GSM), distributed control system (DCS), personal communication service (PCS), global positioning system (GPS), BLUETOOTH, and WiFi technologies typically operate on different frequencies, and may require different antennas.

Thus, there is room for improvement in the art.

DETAILED DESCRIPTION

Figure 1:
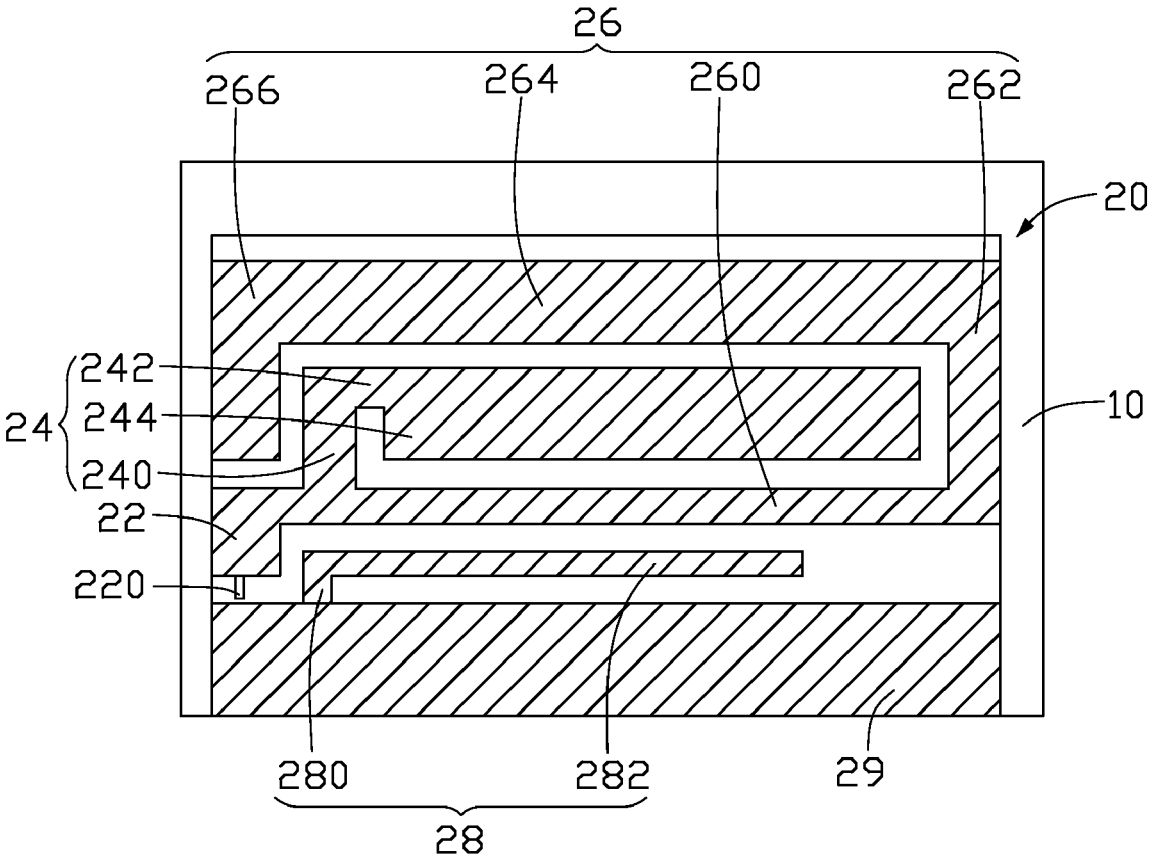
FIG. 1 is a plan view of a multiband antenna in accordance with one embodiment of the present disclosure.

FIG. 1 is a plan view of a multiband antenna 20 in accordance with one embodiment of the present disclosure. The multiband antenna 20 is located on a substrate 10, and includes a first radiator 24, a second radiator 26, a feeding portion 22,a grounding portion 29, and a third radiator 28. The third radiator 28 is separated from the first radiator 24 and the second radiator 26. The second radiator 26 is arranged so as to surround the first radiator 24.

Here, the first radiator 24 is used for transmitting electromagnetic signals in at least two frequency bands, for example GPS and DCS signals bands. The first radiator 24 includes a first transmitting portion 240, a second transmitting portion 242, and a third transmitting portion 244. The first transmitting portion 240 is perpendicularly and electrically connected to one end of the second transmitting portion 242, and the other end of the second transmitting portion 242 is perpendicularly and electrically connected to the third transmitting portion 244. One end of the first transmitting portion 240 is electrically connected to the feeding portion 22, and the second radiator 26. The other end of the first transmitting portion 240 is electrically connected to the second transmitting portion 242. One end of the third transmitting portion 244 is electrically connected to the second transmitting portion 242, and the other end of the third transmitting portion 244 is free. Any adjacent two of first transmitting portions 240, second transmitting portions 242, and third transmitting portions 244 form an "L" shape.

Here, the second radiator 26 surrounds the first radiator 24 for transmitting electromagnetic signals in another frequency band, for example the GSM signal band. The second radiator 26 includes a fourth transmitting portion 260, a fifth transmitting portion 262, a sixth transmitting portion 264, and a seventh transmitting portion 266 perpendicularly and electrically connected. One end of the fourth transmitting portion 260 is electrically connected to the feeding portion 22, and the other end of the fourth transmitting portion 260 is perpendicularly electrically connected to the fifth radiator 262. One end of the seventh transmitting portion 266 is connected to the sixth transmitting portion 264, and the other end of the seventh transmitting portion 266 is free. Any adjacent two of the fourth transmitting portion 260, the fifth transmitting portion 262, the sixth transmitting portion 264, and the seventh transmitting portion 266 form a "L" shape. In detail, the forth transmitting portion 260 and the fifth transmitting portion 262 form a "L" shape, the fifth transmitting portion 262 and the sixth transmitting portion 264 form a "L" shape, and the sixth transmitting portion 264 and the seventh transmitting portion 266 form a "L" shape.

Here, the third radiator 28 includes a eighth transmitting portion 280 and a ninth transmitting portion 282 forming a inverted "L" shape. The third radiator 28 couples to the first radiator 24 and the second radiator 26, and transmits a part of the electromagnetic signals to the first radiator 24 and the second radiator 26. Additionally, the third radiator 28 couples the first radiator 24 and the second radiator 26 to the grounding portion 29. One end of the eighth transmitting portion 280 is perpendicularly electrically connected to the grounding portion 29, and the other end of the eighth transmitting portion 280 is free.

Here, the feeding portion 22 forms a "L" shape. The feeding portion 22 is configured for feeding the electromagnetic signals to the first radiator and the second radiator. The feeding portion 22 may feed electromagnetic signals in a plurality of frequency bands. One end of the feeding portion 22 is electrically connected to the first transmitting portion 240 of the first radiator 24 and the fourth transmitting portion 260 of the second radiator 26, and the other end of the feeding portion 22 is connected to a radio frequency circuit (unlabeled) of an electrical device employing the multiband antenna 20 via a feed point 220. In one example, the feed point 220 is a line having a 50 ohm resistance.

The third transmitting portion 244, the fourth transmitting portion 260, the sixth transmitting portion 264, and the ninth transmitting portion 282 are substantially parallel to one another in a horizontal direction. The first transmitting portion 240, the fifth transmitting portion 262, the seventh transmitting portion 266, and the eighth transmitting portion 280 are substantially parallel to one another in a vertical direction. Thus, the transmitting portions 244, 260, 264, 282 are substantially perpendicular to the transmitting portions 240, 262, 266, 280. There are gaps between the feeding portion 22 and the seventh transmitting portion 266, between the sixth transmitting portion 264 and the third transmitting portion 244, between the third transmitting portion 244 and the fifth transmitting portion 262, between the fourth transmitting portion 260 and the ninth transmitting portion 282, and between the ninth transmitting portion 282 and the grounding portion 29.

Here, the first radiator 24 is used for transmitting global positioning system (GPS) signals, distributed control system (DCS) signals and personal communication system (PCS) signals. The second radiator 26 is used for transmitting global system for mobile communication (GSM) signals. The third radiator 28 is used for transmitting wireless Internet signals, such as WiFi signals, and BLUETOOTH signals.

Figure 2:
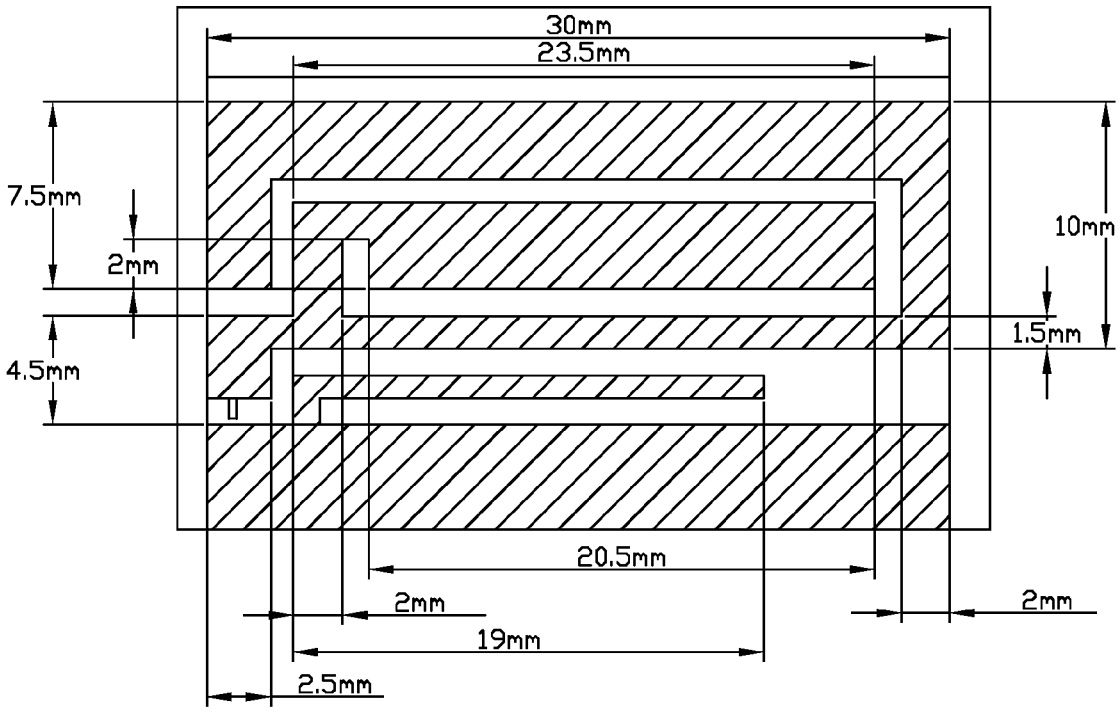
FIG. 2 shows exemplary dimensions of the multiband antenna of FIG. 1.

FIG. 2 shows exemplary dimensions of the multiband antenna 20 of FIG. 1. In the illustrated embodiment, the multiband antenna 20 is rectangular and has a length of about 30 mm, with a width (excluding the grounding portion 29) of about 7.5 mm+4.5 mm+1 mm=13 mm. It may be understood that the dimensions of the disclosed multiband antenna are exemplary and may vary depending on the embodiment.

A distance between the feeding portion 22 and the grounding portion 29 is about 1 mm. A length of the feeding portion 22 is about 4.5 mm−1 mm=3.5 mm, and a width thereof is about 2.5 mm+1 mm=3.5 mm. A length of the first radiator 24 is about 23.5 mm, a width is about 2 mm+1 mm=3 mm. A length of the first transmitting portion 240 is about 1 mm+2 mm+1 mm+1.5 mm=5.5 mm, a width thereof is about 2 mm. A length of the second transmitting portion 242 is about 1 mm, a width is about 1 mm. A length of the third transmitting portion 244 is about 23.5 mm−2 mm−1 mm=20.5 mm, a width is about 1 mm+2 mm=3 mm. A length of the second radiator 26 is about 30 mm, a width is about 10 mm. A length of the fourth transmitting portion 260 is about 23.5 mm+1 mm−2 mm=25.5 mm, a width is about 7.5 mm−3 mm−1 mm=3.5 mm. A length of the fifth transmitting portion 262 is about 10 mm, a width is about 2 mm. A length of the sixth transmitting portion 264 is about 23.5 mm+1 mm*2=25.5 mm. A length of the seventh transmitting portion 266 is about 7.5 mm, a width is about 2.5 mm. The third radiator 28 form a inverted "L" shape, a length is about 19mm and a width is about 4.5 mm−1.5 mm−1 mm=2 mm.

Here, all of the gaps between the feeding portion 22 and the seventh transmitting portion 266, between the sixth transmitting portion 264 and the second transmitting 244, between the second transmitting portion 244 and the fifth transmitting portion 262, between the fourth transmitting portion 260 and the ninth transmitting portion 282, and the ninth transmitting portion 282 and the grounding portion 29 are about 1 mm.

Figure 3:
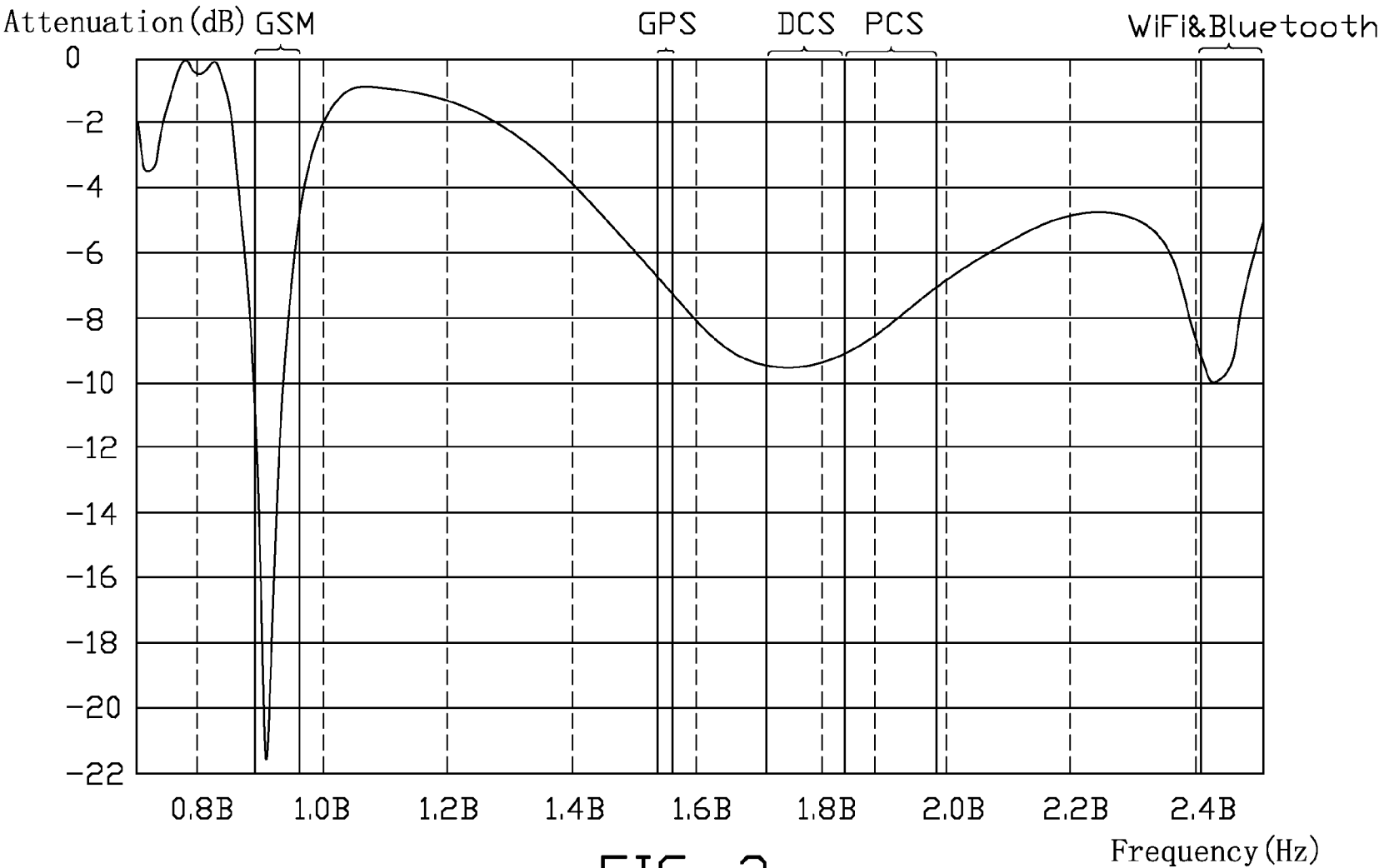
FIG. 3 is an exemplary graph showing a return loss of the multiband antenna of FIG. 1.

FIG. 3 is an exemplary graph showing a return loss of the multiband antenna 20 of FIG. 1. Here, a return loss of the GSM signals radiated by the second radiator 26 ranges from about −21.5 dB to about −5 dB. A return loss of the GPS signals radiated by the first radiator 24 ranges from about −7.5 dB to about −6.5 dB. A return loss of the DCS signals radiated by the first radiator 24 ranges from about −9.5 dB to about −9 dB, and a return loss of the PCS signals radiated by the first radiator 24 ranges from about −9 dB to about −7 dB. Return losses of the WiFi and Bluetooth signals radiated by the third radiator 28 range from about −10 dB to about −5 dB. As shown, the return losses of signals radiated by the multiband antenna 20 are all less than −10 dB, which complies with industry standards.

The description of the present disclosure has been presented for purposes of illustration and description, and is not intended to be exhaustive or limited to the disclosure in the form disclosed. Many modifications and variations will be apparent to those of ordinary skill in the art.

What is claimed is:

1. A multiband antenna, comprising:

a first radiator configured for transmitting electromagnetic signals in at least two frequency bands;

a second radiator connected to and arranged so as to surround the first radiator, the second radiator configured for transmitting electromagnetic signals in a frequency band that is different from frequencies in the at least two frequency bands;

a feeding portion electrically connected to both the first radiator and the second radiator, the feeding portion configured for feeding the electromagnetic signals to the first radiator and the second radiator;

a grounding portion; and a third radiator located between the grounding portion and the second radiator and electrically connected to the grounding portion, the third radiator configured for coupling to the first radiator and the second radiator, transmitting a part of the electromagnetic signals to the first radiator and the second radiator, and coupling the first radiator and the second radiator to the grounding portion.

2. The multiband antenna as recited in claim 1, wherein the first radiator comprises a first transmitting portion, a second transmitting portion, and a third transmitting portion perpendicularly and electrically connected in sequence.

3. The multiband antenna as recited in claim 2, wherein one end of the first transmitting portion is electrically connected to the feeding portion and the second radiator, and the other end of the first transmitting portion is electrically connected to the second transmitting portion.

4. The multiband antenna as recited in claim 3,wherein one end of the third transmitting portion is electrically connected to the second transmitting portion, and the other end of the third transmitting portion is free.

5. The multiband antenna as recited in claim 2, wherein the second radiator comprises a fourth transmitting portion, a fifth transmitting portion, a sixth transmitting portion, and a seventh transmitting portion perpendicularly and electrically connected.

6. The multiband antenna as recited in claim 5, wherein the fourth transmitting portion is electrically connected between the feeding portion and the fifth transmitting portion.

7. The multiband antenna as recited in claim 6, wherein one end of the seventh radiating portion is electrically connected to the sixth transmitting portion, and the other end of the seventh transmitting portion is free.

8. The multiband antenna as recited in claim 5, wherein the third radiator comprises:

an eighth transmitting portion electrically connected to the grounding portion; and a ninth transmitting portion, wherein one end of the ninth transmitting portion is perpendicularly and electrically connected to the eighth transmitting portion, and the other end of the ninth transmitting portion is free.

9. The multiband antenna as recited in claim 8, wherein the ninth transmitting portion, the fourth transmitting portion, the third transmitting portion, and the sixth transmitting portion are substantially parallel to one other in a horizontal direction.

10. The multiband antenna as recited in claim 9, wherein the first transmitting portion, the fifth transmitting portion, the seventh transmitting portion, and the eighth transmitting portion are substantially parallel to one another in a vertical direction.

11. A multiband antenna, comprising:

a grounding portion;

a feeding portion configured for feeding electromagnetic signals in a plurality of frequency bands;

a first radiator with one end electrically connected to the feeding portion and the other end free;

a second radiator with one end electrically connected to the feeding portion and the other end facing the feeding portion so as to surround the first radiator; and a third radiator located between the second radiator and the grounding portion and electrically connected to the grounding portion, the third radiator configured for coupling to the first radiator and the second radiator, transmitting a part of the electromagnetic signals to the first radiator and the second radiator, and coupling the first radiator and the second radiator to the grounding portion.

12. The multiband antenna as recited in claim 11, wherein the first radiator, the second radiator, and the third radiator are formed by one or more "L" shaped transmitting portions.

13. The multiband antenna as recited in claim 11, wherein the other end of the second radiator and the feeding portion define a gap therebetween.

14. The multiband antenna as recited in claim 11, wherein the first radiator comprises a first transmitting portion, a second transmitting portion, and a third transmitting portion perpendicularly and electrically connected in sequence.

15. The multiband antenna as recited in claim 14, wherein the second radiator comprises a fourth transmitting portion, a fifth transmitting portion, a sixth transmitting portion, and a seventh transmitting portion perpendicularly and electrically connected in sequence.

* * * * *